US005995637A

United States Patent [19]

Petersen et al.

[11] Patent Number: 5,995,637

[45] Date of Patent: Nov. 30, 1999

[54] ASSEMBLY HOUSING FOR ELECTROACOUSTICAL TRANSDUCER

[75] Inventors: Holger Petersen, Pastetten; Wilfried Briese, Augsburg, both of Germany

[73] Assignee: Siemens Aktiengesellschaft, Munich, Germany

[21] Appl. No.: 09/106,775

[22] Filed: Jun. 30, 1998

[30] Foreign Application Priority Data

Jul. 24, 1997 [DE] Germany ..... 297 13 202

[51] Int. Cl.[6] ..... H04R 25/00

[52] U.S. Cl. ..... 381/357; 381/150; 381/177

[58] Field of Search ..... 381/150, 355, 381/357, 358, 360, 361, 369, 177, 178

[56] References Cited

U.S. PATENT DOCUMENTS 4,232,205 11/1980 Ribeyre ..... 381/357

4,697,334 10/1987 Madsen et al. ..... 381/369

*Primary Examiner*—Sinh Tran

*Attorney, Agent, or Firm*—Hill & Simpson

[57] ABSTRACT

An assembly housing for accepting an electroacoustical transducer having a rear face with terminal pins proceeding therefrom, contact surfaces thereon, and at least one sound admission opening, is formed by an acceptor plate which is disposed adjacent the rear face of the electroacoustical transducer, and a covering cap which is fitted over the radial edge of the acceptor plate. The acceptor plate has respective openings therein proceeding completely through the acceptor plate which respectively receive the terminal pins, and has blind holes therein which respectively receive springs in registration with the electrical contact surfaces of the electroacoustical transducer. The acceptor plate has a radially-proceeding sound admission channel therein, with one end in registration with the sound admission opening in the rear face of the transducer, and an opposite end in registration with a sound admission opening in the covering cap.

2 Claims, 1 Drawing Sheet

FIG. 1
(PRIOR ART)
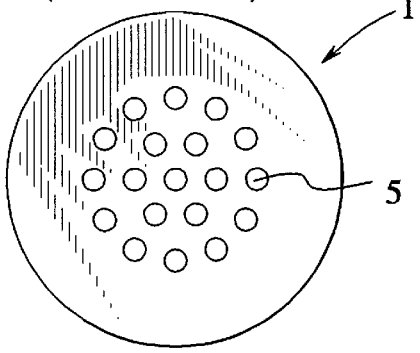
FIG. 4
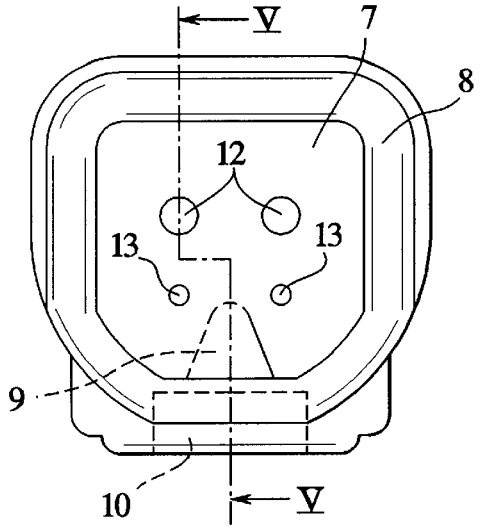
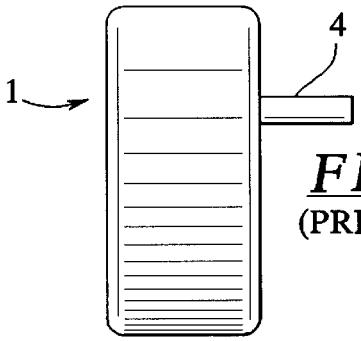
FIG. 2
(PRIOR ART)
FIG. 5
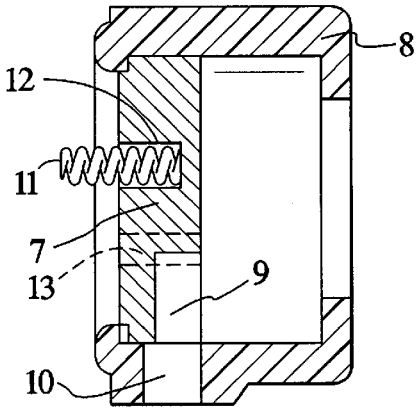
FIG. 5A
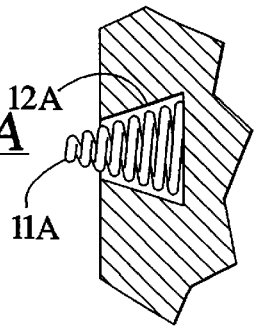
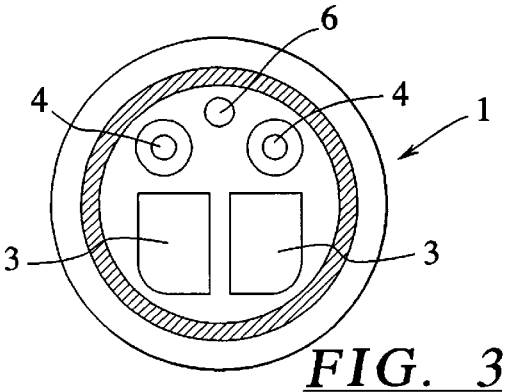
FIG. 3
(PRIOR ART)
FIG. 6
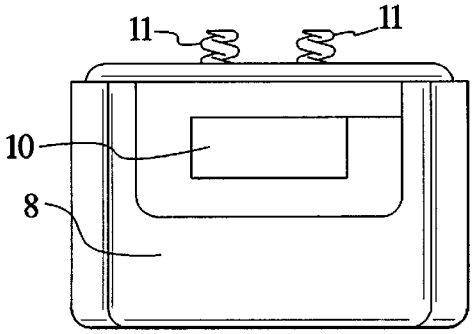

ASSEMBLY HOUSING FOR ELECTROACOUSTICAL TRANSDUCER

BACKGROUND OF THE INVENTION

1. Field of the Invention

The present invention is directed to an assembly housing for accepting a cylindrical electroacoustical transducer, of the type commonly used in hearing aids, the transducer at its front side having a number of dynamically balanced sound-admitting openings, and at its rear side having contact surfaces for making electrical contact with a housing component which are not dynamically balanced, terminal pins, and at least one non-dynamically balanced sound admission opening.

2. Description of the Prior Art

Cylindrical electroacoustical transducers of the above type are known and are commonly employed as an electroacoustical transducer in hearing aids. The electrical contacts to the transducer are automatically made during assembly by means of a tubular rubber guide, or a leaf spring to position the transducer, followed by hand soldering of leaf spring contact to the transducer. This type of electrical contact is employed particularly in pressure gradient microphones having sound admission openings, at the rear side thereof, which generally are not dynamically balanced (in comparison to the sound admission openings on the front side, which are dynamically balanced).

In conventional transducers and housings of this type, the electrical contact does not produce a uniform contact force in the case of somewhat large tolerances of the magnitude which can be typically expected for components of this type. In conventional arrangements, there is also the possibility of plastic spring deformation occurring in the assembly and handling. Moreover, because of the relatively small size of the components, the assembly itself is difficult, particularly in the case of pressure gradient microphones.

SUMMARY OF THE INVENTION

It is an object of the present application to provide an assembly housing for an electroacoustical transducer of the above-described type, wherein a reliable automatic contacting is enabled in a simple fashion.

The above object is achieved in accordance with the principles of the present invention in an assembly housing for an electroacoustical transducer of the above-described type, wherein the assembly housing has an electrically conductive (metallic) acceptor plate for the transducer, this acceptor plate having two holes extending completely through the acceptor plate for receiving and guiding the terminal pins of the transducer, at least one radially-proceeding channel which is located in registration with a sound entry opening in the rear side of the transducer and two blind holes, respectively in registration with the contact surfaces for producing the automatic contacting, in which helical springs are respectively held which project away from the acceptor plate on a side thereof opposite the side of the acceptor plate which faces the transducer. The housing assembly also has a covering cap which is placed over the transducer, and which has a rear edge which engages in a locking manner with the radial edge of the acceptor plate. The covering cap has at least one sound admission opening which adjoins the radially-proceeding sound admission channel of the acceptor plate.

The assembly housing according to the invention provides a stable, vibration-proof contacting arrangement with a uniform contact force over large tolerances and thickness variations of the transducer. A further advantage compared to known housing assemblies is that the inventive assembly presents only a very low possibility of plastic deformation. For microphones with a sound admission opening at a rear side thereof, the inventive housing assembly provides automatic contacting without the need for hand soldering in order to achieve a defined acoustical behavior. The existing terminal pins on the transducer are utilized for positioning the electroacoustical transducer in a defined manner.

In an embodiment of the invention, the end of each helical spring which is received into one of the blind holes in the acceptor plate has flights of increasing diameter, the diameter of the flights increasing as the spring penetrates farther into the acceptor plate, so that the largest diameter exists at the end of the helical spring which abuts the acceptor plate. The blind opening in the acceptor plate has a correspondingly increasing diameter, i.e., it is cone-shaped, so as to accept the helical spring therein in a manner which automatically retains the spring in the blind opening.

DESCRIPTION OF THE DRAWINGS

FIG. 1 shows the front side of a conventional electroacoustical transducer.

FIG. 2 shows a side view of the conventional electroacoustical transducer of FIG. 1.

FIG. 3 shows a back view of the conventional electroacoustical transducer of FIGS. 1 and 2.

FIG. 4 shows a back view of an assembly housing constructed in accordance with the principles of the present invention, for the electroacoustical transducer of FIGS. 1–3.

FIG. 5 is a sectional view, taken along line V—V of FIG. 4, of the inventive electroacoustical assembly housing.

FIG. 5A shows a section of a detail of a further embodiment of the inventive assembly housing.

FIG. 6 a side view of the inventive assembly housing shown in FIGS. 4 and 5.

DESCRIPTION OF THE PREFERRED EMBODIMENTS

The conventional electroacoustical transducer 1 shown from the front in FIG. 1, such as a microphone capsule, has a number of dynamically balanced frontal sound admission openings 5, and a rear sound admission opening 6, which is not dynamically balanced, which can be seen in the back view shown in FIG. 3. The electroacoustical transducer 1 also has two terminal pins 4 which project from the back side thereof, and soldering pads 3 located at the back side thereof for making electrical contact with other types of terminals, such as leaf spring contacts.

The electroacoustical transducer 1 must be contained within a housing, and during assembly of the electroacoustical transducer 1 into such a housing, electrical contact of, for example, leaf spring contacts, with the soldering pads 3 must be made. For this purpose, not only must the electroacoustical transducer 1 be radially positioned in an accurate manner within the housing, so that ends of the leaf spring contacts respectively mate with the soldering pads 3, but also the electroacoustical transducer 1 must be properly positioned as to its depth within the housing so that the spring 4 is produced by the leaf spring contacts is sufficient to urge them against the respective soldering pads 3. Such depth positioning can possibly present a problem if transducers exhibit significant tolerance variations in thickness (i.e., the distance from front to back exemplified by the side view shown in FIG. 2).

These assembly problems are overcome in the inventive assembly housing shown in FIGS. 4 through 6. The inventive housing has an electrically conductive acceptor plate 7, with openings 13 therein which extend for completely through the acceptor plate 7 and receive and guide the respective terminal pins 4. The transducer 1 is therefore positioned radially relative to the acceptor plate 7 by the passage of the terminal pins 4 through the openings 13. Contacting surfaces can be placed at the rear wall of the microphone capsule at defined distances relative to the terminal pins 4.

When the terminal pins 4 are properly proceeding through the openings 13, a sound admission channel 9 in the acceptor plate 7 comes to lie in registration with the rear sound admission opening 6 of the electroacoustical transducer 1.

The acceptor plate 7 additionally has blind holes 12 therein, i.e., holes which do not proceed completely through the acceptor plate 7. Each of these blind holes 12 receives a helical spring 11, in registration with the respective soldering pads 3, so that the acceptor plate 7 is securely and uniformly pressed against the soldering pads 3 if necessary, insulation can be provided to produce separate conducting pads for the respective soldering pads 3.

The inventive housing also has a covering cap 8 of insulating material, such as slightly elastic rubber, which can be pressed around the edges of the acceptor plate 7, with the electroacoustical transducer 1 contained in the opening which is produced inside the combination of the covering cap 8 and the acceptor plate 7. The covering cap 8 produces a seal against undesirable sound admission, except for admission through the designated openings 5 and 6. The covering cap 8 has a sound admission opening 10 which is disposed so that it adjoins the sound admission channel 9 in the acceptor plate 7, so that an unobstructed acoustical transmission path from the exterior of the housing to the sound admission opening 6 is produced.

As shown in FIG. 5A, a further embodiment of a helical spring 11A has an increasing diameter at the end thereof which proceeds into the acceptor pate 7. The blind hole 12A in this embodiment is correspondingly shaped, i.e., it is cone-shaped, to accept the helical spring 11A of increasing diameter. The helical spring 11A thus holds itself inside the blind hole 12A, without any need for additional retaining measures.

Although modifications and changes may be suggested by those skilled in the art, it is the intention of the inventors to embody within the patent warranted hereon all changes and modifications as reasonably and properly come within the scope of their contribution to the art.

We claim as our invention:

1. An assembly housing for use with an electroacoustical transducer having a front face with a plurality of dynamically balanced sound admission openings therein and a rear face having a non-dynamically balanced sound admission opening therein, a plurality of terminal pins and a plurality of electrical contact surfaces, said assembly housing comprising:

an acceptor plate adapted to abut said rear face of said electroacoustical transducer, said acceptor plate having a plurality of openings therein extending completely through said acceptor plate in registration with said plurality of terminal pins, a plurality of blind holes at a side of said acceptor plate facing away from said electroacoustical transducer, said blind holes being respectively in registration with said electrical contact surfaces, a plurality of spiral springs respectively received in said blind holes, and a radially-proceeding sound admission channel having a first end in registration with said sound admission opening at said rear face of said electroacoustical transducer and having a second end disposed at a radial edge of said acceptor plate; and a covering cap having an interior edge engageable in locking fashion with said radial edge of said acceptor plate, said covering cap having a sound admission opening therein in registration with said second end of said sound admission channel in said acceptor plate.

2. An assembly housing as claimed in claim 1 wherein each of said spiral springs has an end with flights successively increasing in diameter, and wherein each of said blind holes in said acceptor plate is cone-shaped so that said helical springs are respectively held therein.

* * * * *